US006345554B1

(12) United States Patent
Wang

(10) Patent No.: US 6,345,554 B1
(45) Date of Patent: Feb. 12, 2002

(54) DETACHABLE VEHICLE TIRE WRENCH

(76) Inventor: Peter Wang, No. 425, Hsihu Rd., Tali City, Taichung County (TW)

( * ) Notice: Subject to any disclaimer, the term of this patent is extended or adjusted under 35 U.S.C. 154(b) by 0 days.

(21) Appl. No.: 09/837,218

(22) Filed: Apr. 19, 2001

(51) Int. Cl.[7] ..... B25B 13/06
(52) U.S. Cl. ..... 81/124.4; 81/177.2
(58) Field of Search ..... 81/121.1, 124.4, 81/177.2; 403/174, 217, 218, 219

(56) References Cited

U.S. PATENT DOCUMENTS 2,763,172 A * 9/1956 Richards ..... 81/177.2
3,837,754 A * 9/1974 Malcik ..... 403/217
4,939,960 A * 7/1990 Kinzli ..... 81/124.4
5,020,398 A * 6/1991 Leu ..... 81/124.4
D409,060 S * 5/1999 Lucy ..... D8/24

* cited by examiner

*Primary Examiner*—Eileen P. Morgan
*Assistant Examiner*—Joni B. Danganan
(74) *Attorney, Agent, or Firm*—Rosenberg, Klein & Lee

(57) ABSTRACT

A detachable vehicle tire wrench includes a base block, the base block having a threaded center through hole and four radial through holes equiangularly spaced around the periphery in communication with the threaded center through hole, four socket bars respectively detachably inserted into the radial through holes of the base block, each socket bar having an outer end terminating in a socket for grasping/turning a screw bolt or nut, and a locking block threaded into the threaded center through hole of the base block to lock the socket bars.

1 Claim, 4 Drawing Sheets

DETACHABLE VEHICLE TIRE WRENCH

BACKGROUND OF THE INVENTION

The present invention relates to wrenches and, more specifically, to a detachable vehicle tire wrench that can be alternatively arranged into one of a series of forms to fit different working requirements.

A regular vehicle tire wrench, as shown in FIG. 1, is generally comprised of a crossed handle formed of a main handlebar 1 and two auxiliary handlebars 3 welded to the main handlebar 1, and four sockets 2 at the four ends of the crossed handlebar. This structure of vehicle tire wrench has drawbacks as follows:

1. Because the auxiliary handlebars 3 are welded to the main handlebar 1, the vehicle tire wrench is not detachable and inconvenient to carry.
2. Because the crossed handle is not detachable and the vehicle tire wrench is not adjustable, the vehicle tire wrench cannot fit different working requirements in different working positions.

SUMMARY OF THE INVENTION

The present invention has been accomplished to provide a vehicle tire wrench, which eliminates the aforesaid drawbacks. It is one object of the present invention to provide a vehicle tire wrench, which is detachable. It is another object of the present invention to provide a detachable vehicle tire wrench, which can be arranged into one of a series of forms to fit different working requirements. It is still another object of the present invention to provide a detachable vehicle tire wrench, which is durable in use. According to one aspect of the present invention, the detachable vehicle tire wrench is comprised of a base block, the base block having a threaded center through hole and four radial through holes equiangularly spaced around the periphery in communication with the threaded center through hole, four socket bars respectively detachably inserted into the radial through holes of the base block, each socket bar having an outer end terminating in a socket for grasping/turning a screw bolt or nut, and a locking block threaded into the threaded center through hole of the base block to lock the socket bars. According to another aspect of the present invention, the bar sockets each have an annular position groove disposed around the periphery at one end remote from the respective socket, and the locking block comprises an annular bottom locating flange adapted to engage the annular positioning groove of each socket bar.

DETAILED DESCRIPTION OF THE PREFERRED EMBODIMENT

Figure 1:
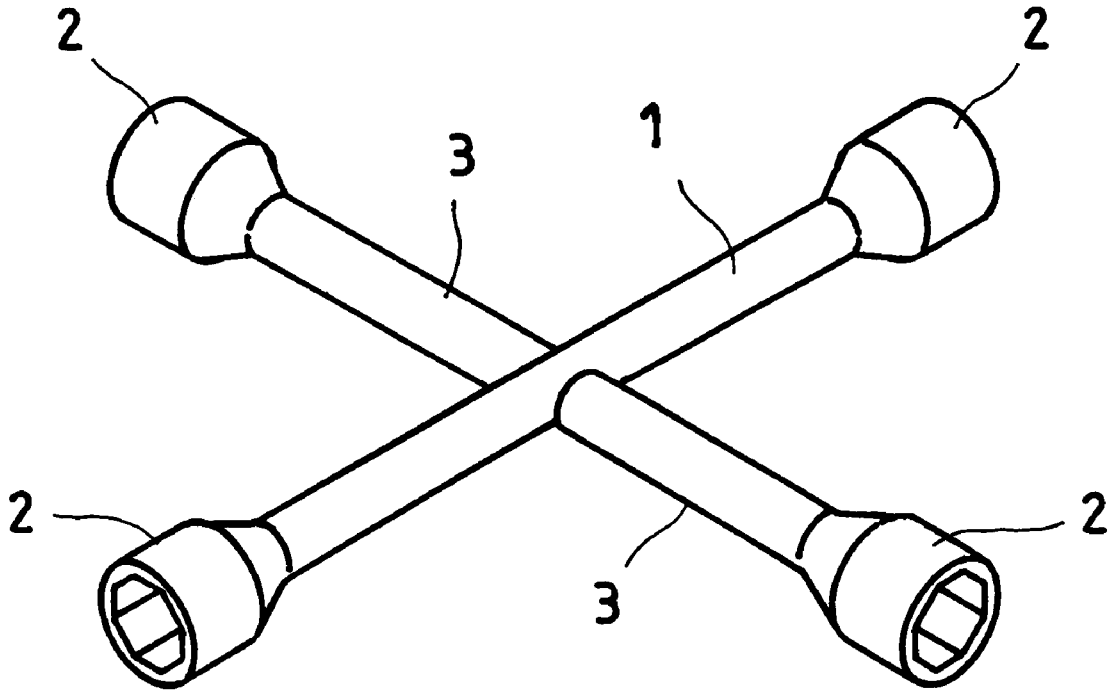
FIG.1 PRIOR ART
FIG. 1 is a perspective view of a vehicle tire wrench according to the prior art.
Figure 2:
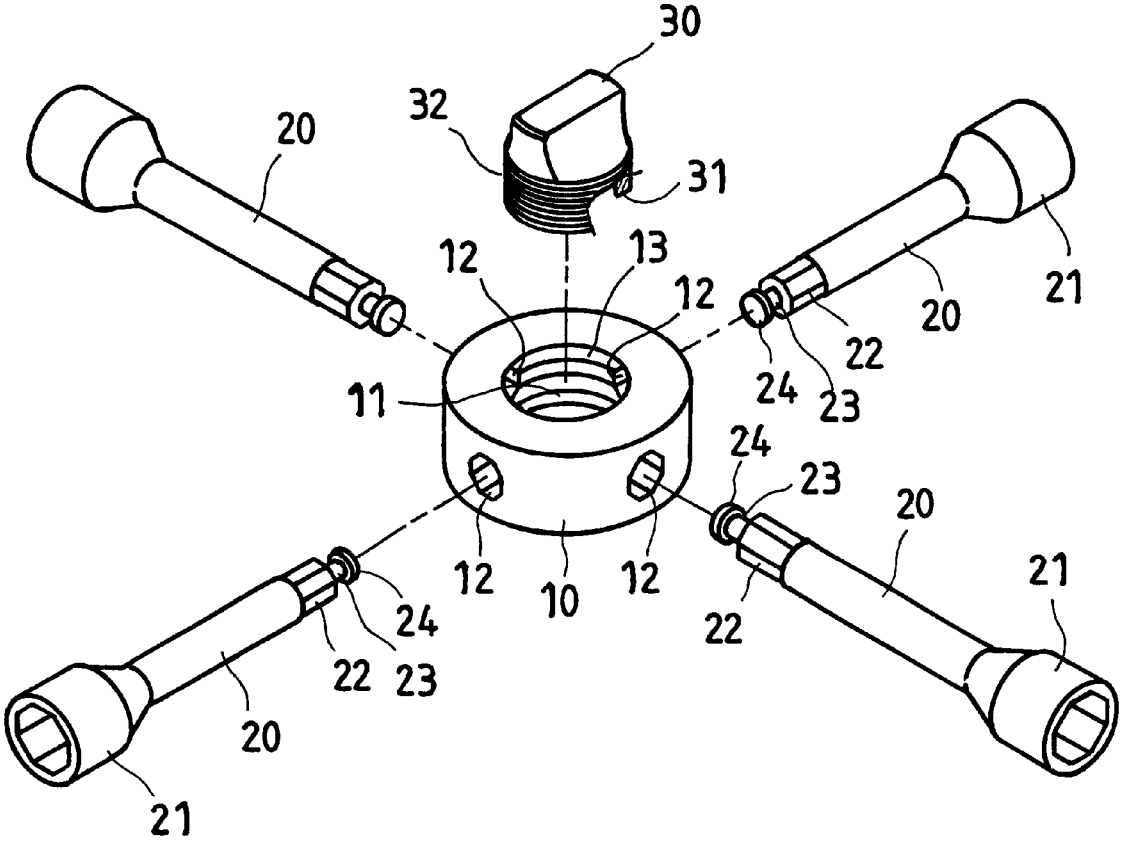
FIG. 2 is an exploded view of a detachable vehicle tire wrench according to the present invention.
Figure 3A:
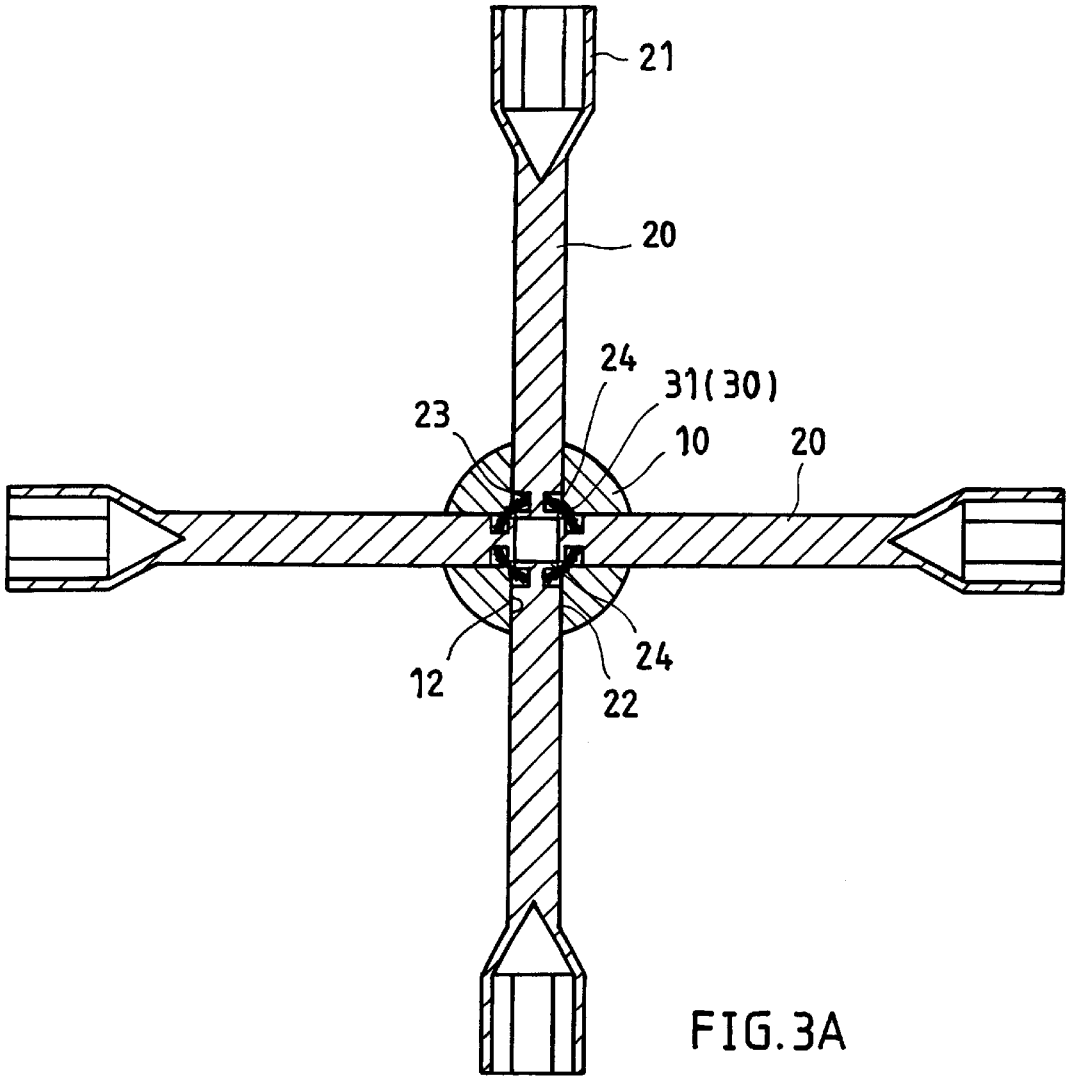
FIG. 3A is a top view in section of the detachable vehicle tire wrench according to the present invention.
Figure 3B:
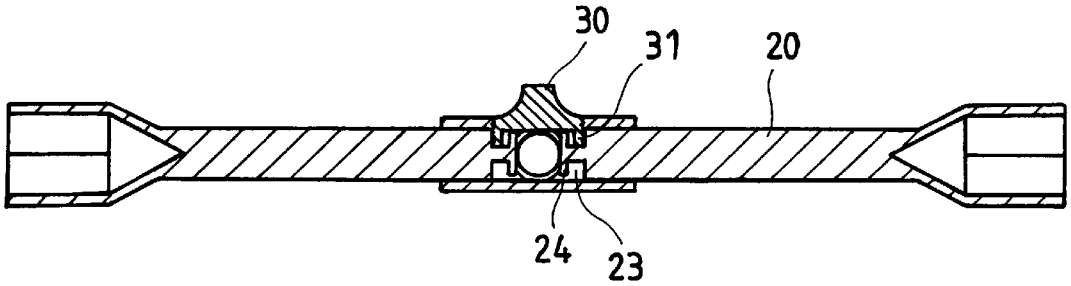
FIG. 3B is a side view in section of the detachable vehicle tire wrench according to the present invention.

Referring to FIGS. 2, 3A, and 3B, a vehicle tire wrench in accordance with the present invention is generally comprised of a base block 10, four socket bars 20, and a locking block 30.

The base block 10 comprises a center through hole 11, inner threads 13 disposed in the center through hole 11, and four non-circular radial through holes 12 equiangularly extended through the periphery in communication with the center through hole 11. The socket bars 20 each comprises a socket 21 at one end, an end block 24 at an opposite end, a non-circular front section 22 disposed adjacent to the end block 24 and fitting the non-circular radial through holes 12 of the base block 10, and an annular positioning groove 23 disposed around the periphery between the end block 24 and the non-circular front section 22. The non-circular front section 22 of each socket bar 20 is respectively fitted into the radial through holes 12 of the base block 10, keeping the annular positioning groove 23 and end block 24 of each socket bar 20 respectively suspending in the center through hole 11 of the base block 10. The locking block 30 comprises a threaded shank 32 threaded into the inner threads 13 in the center through hole 11 of the base block 10, and an annular locating flange 31 downwardly extended from the bottom end edge thereof and engaged into the annular positioning groove 23 of each socket bar 20 to lock the socket bars 20.

When not in use, the locking block 30 is turned upwards and disengaged from the annular positioning groove 23 of each socket bar 20 to unlock the socket bars 20, enabling the socket bars 20 to be disconnected from the base block 10. Thus, the socket bars 20 can be put together and received with the base block 10 and the locking block 30 in a tool bag. When in use, the socket bars 20 are respectively inserted into the radial through holes 12 of the base block 10, and then the locking block 30 is rotated downwards in the center through hole 11 of the base block 10 to force the annular locating flange 31 into engagement with the annular positioning groove 23 of each socket bar 20, keeping the socket bars 20 positively secured to the base block 10.

Figure 4A:
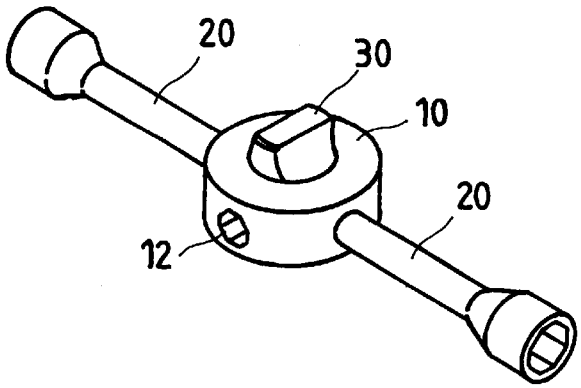
FIG. 4A shows one arrangement of the detachable vehicle tire wrench according to the present invention.
Figure 4B:
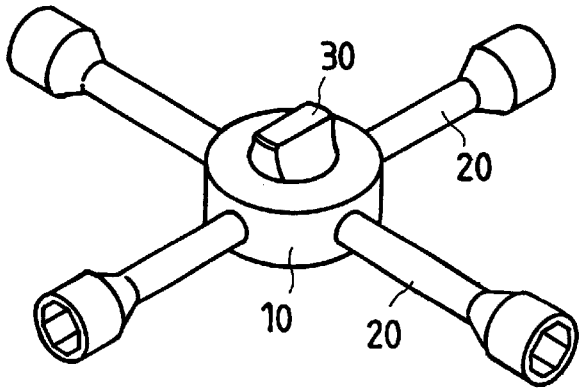
FIG. 4B shows another arrangement of the detachable vehicle tire wrench according to the present invention
Figure 4C:
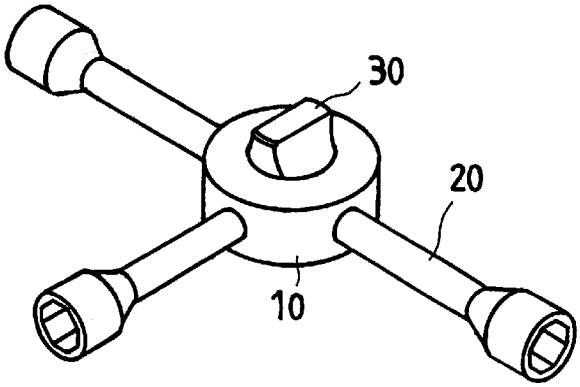
FIG. 4C shows still another arrangement of the detachable vehicle tire wrench according to the present invention.
Figure 4D:
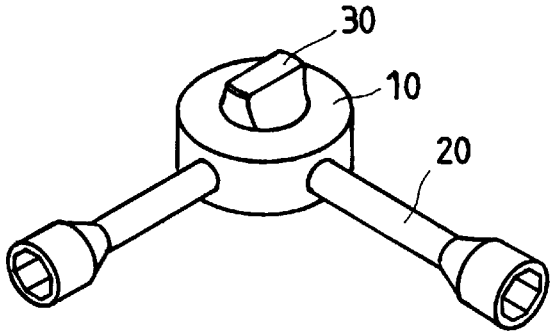
FIG. 4D shows still another arrangement of the detachable vehicle tire wrench according to the present invention.

The vehicle tire wrench can be alternatively arranged into different working forms to fit different working requirements as shown in FIGS. from 4A through 4D. In FIG. 4A, two socket bars 20 are fastened to the base block 10 and longitudinally aligned at two opposite sides. In FIG. 4B, the four socket bars 20 are installed in the base block 10, showing a crossed profile. In FIG. 4C, three socket bars 20 are fastened to the base block 10, forming a T-shaped profile. According to the arrangement shown in FIG. 4C, the two longitudinally aligned socket bars 20 serve as handle means for turning with the hands, and the other socket bar 20 is used to grip or rotate the screw bolt or nut. In FIG. 4D, two socket bars 20 are fastened to two adjacent radial through holes of the base block 10 with one socket bar 20 serving as handle means and the other socket bar 20 for grasping or rotating the workpiece.

Further, the socket bars 20 and the locking block 30 are respectively made from metal. When the base block 10, the socket bars 20 and the locking block 30 are fastened together, the vehicle tire wrench provides a high structural strength. Because the annular locating flange 31 of the locking block 30 is forced into engagement with the annular positioning groove 23 of each socket bar 20, the annular locating flange 31 of the locking block 30 and the base block 10 commonly bear the torsional force transmitted from the socket bars 20 when operating the vehicle tire wrench to rotate the workpiece. Because the locking block 30 bears much torsional force from the socket bars 20, the base block 10 can be made from plastics for the advantage of light in weight. Of course, metal can be used to fabricate the base block 10.

A prototype of vehicle tire wrench has been constructed with the features of FIGS. 2~4D. The vehicle tire wrench functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A detachable vehicle tire wrench comprising:

a base block, said base block comprising a center through hole, inner threads disposed in said center through hole, and four non-circular radial through holes equiangularly extended through the periphery thereof in communication with said center through hole;

four socket bars for attaching to said base block, said socket bars each comprising a socket at one end, an end block at an opposite end, a non-circular front section disposed adjacent to said end block and fitting the non-circular radial through holes of said base block, and an annular positioning groove disposed around the periphery of the respective socket bar between said end block and said non-circular front section; and a locking block detachably fastened to said base block to lock said socket bars in the radial through holes of said base block said locking block comprising a threaded shank threaded into the inner threads in the center through hole of said base block, and an annular locating flange downwardly extended from a bottom end edge thereof and adapted to engage the annular positioning groove of each of said socket bars after insertion of the non-circular front section of each of said socket bars into the radial through holes of said base block.

* * * * *